US011639796B2

(12) United States Patent
Cowan et al.

(10) Patent No.: US 11,639,796 B2
(45) Date of Patent: May 2, 2023

(54) GAS COOKING APPLIANCE WITH ACTIVE IGNITER INDICATOR

(71) Applicant: Midea Group Co., Ltd., Foshan (CN)

(72) Inventors: Richard W. Cowan, Louisville, KY (US); Felix Conde Zelocuatecatl, Louisville, KY (US)

(73) Assignee: MIDEA GROUP CO., LTD., Guangdong (CN)

( * ) Notice: Subject to any disclaimer, the term of this patent is extended or adjusted under 35 U.S.C. 154(b) by 151 days.

(21) Appl. No.: 17/111,929

(22) Filed: Dec. 4, 2020

(65) Prior Publication Data

US 2022/0178547 A1 Jun. 9, 2022

(51) Int. Cl.
*F24C 3/12* (2006.01)
*F24C 3/10* (2006.01)
*F24C 3/08* (2006.01)

(52) U.S. Cl.
CPC ..... *F24C 3/124* (2013.01); *F24C 3/087* (2013.01); *F24C 3/103* (2013.01)

(58) Field of Classification Search
CPC ..... F23C 3/124; F23C 3/087; F23C 3/103
USPC ..... 126/39 BA
See application file for complete search history.

(56) References Cited

U.S. PATENT DOCUMENTS 3,529,584 A 9/1970 Celaya
4,019,855 A * 4/1977 Camillo ..... F24C 3/103 200/61.86
4,681,084 A 7/1987 Grech
5,094,259 A 3/1992 Hsu
5,787,874 A 8/1998 Krohn et al.
6,619,613 B1 9/2003 Akamatsu et al.
7,428,901 B2 9/2008 Gama et al.
7,527,072 B2 5/2009 Crnkovich
7,568,909 B2 8/2009 MacNutt et al.
8,100,121 B2 1/2012 Clauss et al.
8,766,116 B2 7/2014 Barrena et al.
9,004,058 B1 * 4/2015 Brown ..... F24C 1/10 126/30
9,068,752 B2 6/2015 Shaffer et al.
9,709,284 B2 7/2017 Bach et al.
9,746,186 B2 8/2017 Moro et al.
9,765,966 B2 * 9/2017 Herzog ..... H01H 19/62
10,344,984 B2 7/2019 Golomb
10,504,673 B2 12/2019 Cha
11,441,782 B2 9/2022 Cowan
2010/0216080 A1 8/2010 Home
2010/0253653 A1 10/2010 Stambaugh et al.
2012/0247452 A1 10/2012 Pianezze
(Continued)

FOREIGN PATENT DOCUMENTS

CN 104500830 A 4/2015
CN 204459413 U 7/2015
(Continued)

OTHER PUBLICATIONS

Related Applications Transmittal dated Dec. 8, 2020.
(Continued)

*Primary Examiner* — Vivek K Shirsat
(74) *Attorney, Agent, or Firm* — Gray Ice Higdon

(57) ABSTRACT

A cooking appliance and method generate an audible and/or visual indication to a user while an igniter is activated during ignition of a gas burner to notify the user that the igniter is active.

18 Claims, 7 Drawing Sheets

(56) References Cited

U.S. PATENT DOCUMENTS

| | | | | |
|---|---|---|---|---|
| 2012/0285243 | A1 | 11/2012 | Yamamoto | |
| 2013/0260320 | A1 | 10/2013 | Townsend | |
| 2014/0001173 | A1 | 1/2014 | Holzgreve | |
| 2015/0037737 | A1 | 2/2015 | Pottenger et al. | |
| 2015/0193073 | A1 | 7/2015 | Dmytriw et al. | |
| 2016/0348916 | A1* | 12/2016 | French | F16K 37/0025 |
| 2017/0238751 | A1 | 8/2017 | Vengroff | |
| 2018/0245795 | A1* | 8/2018 | Serabatir | F24C 7/082 |
| 2020/0011534 | A1 | 1/2020 | Park et al. | |
| 2020/0103110 | A1 | 4/2020 | Buescher et al. | |
| 2022/0178538 | A1 | 6/2022 | Cowan et al. | |

FOREIGN PATENT DOCUMENTS

| | | | |
|---|---|---|---|
| CN | 206648088 | U | 11/2017 |
| CN | 108019800 | A | 5/2018 |
| GB | 1493580 | A | 11/1977 |
| JP | S57108525 | A | 7/1982 |
| JP | H0391618 | A | 4/1991 |
| JP | 2001059618 | A | 3/2001 |
| KR | 200477877 | Y1 | 8/2015 |

OTHER PUBLICATIONS

Day, Lewin, Stove Alarm Keeps the Kitchen Safe, Hackaday, Retrieved from: https://hackaday.com/2018/12/09/stove-alarm-keeps-the-kitchen-safe/, dated Dec. 9, 2018 (27 pages).

BurnerAlert, BurnerAlert Stove Reminder Disc, Amazon.com, Retrieved from:https://www.amazon.com/BurnerAlert-Stove-Reminder-Color-White/dp/B07PP7P9S3, Retrieved on Apr. 6, 2021.

Related Applications Transmittal, dated Oct. 8, 2021.

United States Patent and Trademark Office, Non-Final Office Action issued in U.S. Appl. No. 17/111,937, 30 pages, dated Aug. 1, 2022.

Shirsat, Vivek K., United States Patent and Trademark Office, Notice of Allowance issued in U.S. Appl. No. 17/111,937, 21 pages, dated Sep. 21, 2022.

U.S. Patent and Trademark Office, Office Action issued in U.S. Appl. No. 17/489,993 dated Jan. 4, 2023.

* cited by examiner

GAS COOKING APPLIANCE WITH ACTIVE IGNITER INDICATOR

BACKGROUND

Cooking appliances such as cooktops, ovens and ranges may be powered by various types of burners or cooking elements, with electrical heating elements and gas burners being among the most common. In particular, gas burners generally use as an energy source a combustible gas such as natural gas or liquified petroleum (LP) gas (also referred to as propane), and generate heat by combusting and burning the gas. The output levels of gas burners are generally controlled by valves, which regulate gas flow to the gas burners, and which are coupled either mechanically or electronically to associated user controls, e.g., knobs, sliders, or the like. Gas burners also generally require some manner of igniting the burners. For gas cooktop burners, for example, spark igniters are commonly used, while for gas oven burners, hot surface igniters are also commonly used. In addition, some cooking appliances incorporate automatic ignition modules that include flame sensors and that are capable of automatically re-igniting a gas burner in response to a detected flame loss by a flame sensor.

With many manual gas cooktops, for example, a control knob is typically mechanically coupled to a gas valve, and a switch is used to activate a spark igniter when the control knob is in a particular range of rotational positions or when the control knob is pressed inwardly. The gas valve is designed so that, from an off position, the gas valve remains closed for a portion of the rotation but then opens relatively quickly to a maximum flow position at about a one quarter turn (90 degrees) from the off position, which corresponds to the maximum output level for the gas burner. Turning the knob further through the next half turn gradually reduces the flow rate until a minimum flow position is reached at about a three quarter turn (270 degrees) from the off position, whereby further turning is restricted Many manual gas cooktops are specifically designed so that the igniter turns on before gas begins flowing through the valve to prevent the flow of unburned gas, and then turns off slightly before the maximum flow position is reached. The igniter, if implemented as a spark igniter, generally produces a series of sparks at repeatable intervals, which produces a distinctive clicking sound that lets the user know that the igniter is active. For hot surface igniters, the problem is more acute, since these igniters are more commonly used for ovens and emit no sound, so a user would generally not be aware when a hot surface igniter was active.

In addition, even when a user is able to see and/or hear the sparks generated by an igniter, a user still may have difficulty properly igniting the burner because the gas flow is insufficient for ignition. Since the igniter is turned on prior to gas flow, the fact that the igniter is on is not an indication that the valve is in a position to output sufficient gas flow to ignite the burner. As such, a user is often required to turn the knob back and forth to search out the proper position where the burner will ignite.

Automatic ignition systems also suffer from similar issues, as a user may not always be aware when a flame has been lost and re-ignition has occurred. While many automatic ignition systems incorporate functionality to shut off gas flow if re-ignition cannot be attained, where re-ignition can be successfully attained, a user may not be aware that the re-ignition occurred, so the root cause of that flame loss (e.g., a draft, an open door, etc.) may cause re-ignition to be needed multiple times, whereas if the user was aware of the re-ignition the user could potentially address that root cause and prevent further flame loss in the first place.

SUMMARY

The herein-described embodiments address these and other problems associated with the art by utilizing a control circuit in a gas cooking appliance to generate an audible and/or visual indication to a user while an igniter is activated to notify the user that the igniter is active.

Therefore, consistent with one aspect of the invention, a cooking appliance may include a gas burner, an igniter disposed adjacent to the gas burner to ignite the gas burner, a gas valve configured to regulate gas flow to the gas burner, a burner control coupled to the gas valve to vary the gas flow to the gas burner, and a control circuit coupled to the igniter and configured to activate the igniter when gas is flowing to the gas burner, and the control circuit further configured to generate an indication to a user while the igniter is activated to notify the user that the igniter is active.

Also, in some embodiments, the control circuit is configured to generate the indication by generating an audible indication. In addition, in some embodiments, the control circuit includes a speaker, and the audible indication is generated by the speaker. Moreover, in some embodiments, the control circuit is configured to generate the indication by generating a visual indication. In some embodiments, the burner control includes a rotary control actuator and an illumination source, and the control circuit is configured to generate the indication using the illumination source. Further, in some embodiments, the illumination source is a light ring that circumscribes the rotary control actuator. In some embodiments, the control circuit is configured to generate the indication by illuminating the illumination source in a first color, and to illuminate the illumination source in a second color when the burner control is in an operational position and the igniter is not activated. Moreover, in some embodiments, the control circuit is configured to generate the indication by illuminating the illumination source using a first illumination pattern, and to illuminate the illumination source with a second illumination pattern when the burner control is in an operational position and the igniter is not activated.

Some embodiments may further include a flame detector positioned to sense a flame emitted by the gas burner, and the control circuit is further configured to activate the igniter to re-ignite the burner in response to detecting a flame loss for the burner, and to generate a second indication to the user while the igniter is activated to notify the user that the igniter is active during re-ignition of the burner. In some embodiments, the second indication is more pronounced than the first indication.

Also, in some embodiments, the gas valve includes a mechanical gas valve, and the burner control is mechanically coupled to the mechanical gas valve to vary the gas flow to the gas burner. Moreover, in some embodiments, the control circuit is configured to activate the igniter in response to a position of the burner control.

In addition, in some embodiments, the gas valve includes an electromechanical gas valve, and the burner control is electronically coupled to the mechanical gas valve through the control circuit to vary the gas flow to the gas burner. Also, in some embodiments, the control circuit is configured to activate the igniter in response to user input separate from a position of the burner control.

In some embodiments, the gas burner is a cooktop burner. In addition, in some embodiments, the gas burner is an oven burner. Also, in some embodiments, the control circuit includes a visual or audio device that is activated whenever the igniter is activated. In some embodiments, the visual or audio device is coupled in parallel with or in series with the igniter in an igniter driver circuit of the control circuit. Moreover, in some embodiments, the igniter is a spark igniter. In some embodiments, the igniter is a hot surface igniter.

These and other advantages and features, which characterize the invention, are set forth in the claims annexed hereto and forming a further part hereof. However, for a better understanding of the invention, and of the advantages and objectives attained through its use, reference should be made to the Drawings, and to the accompanying descriptive matter, in which there is described example embodiments of the invention. This summary is merely provided to introduce a selection of concepts that are further described below in the detailed description, and is not intended to identify key or essential features of the claimed subject matter, nor is it intended to be used as an aid in limiting the scope of the claimed subject matter.

DETAILED DESCRIPTION

In the embodiments discussed hereinafter, a gas cooking appliance may generate various indications associated with ignition of a gas burner. In some embodiments, for example, a control circuit may be used to generate an audible and/or visual indication to a user when a user control for a gas burner is in a position within which an igniter is active and a gas valve is supplying sufficient gas flow to the gas burner to support ignition and thereby assist a user in properly positioning the user control during ignition of the burner. Further, in some embodiments, a control circuit may be used to generate an audible and/or visual indication to a user while an igniter is activated to notify the user that the igniter is active.

Figure 1:
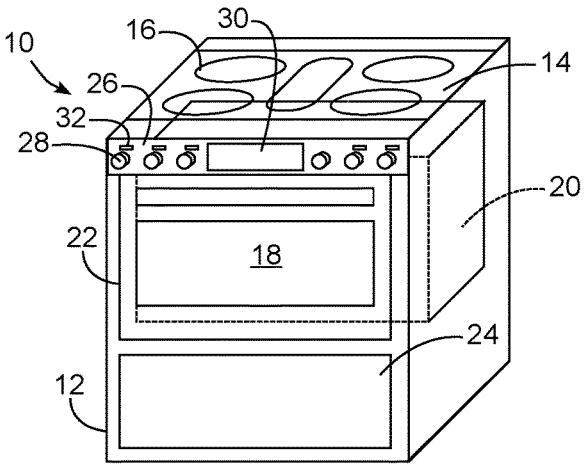
FIG. 1 is a perspective view of a cooking appliance consistent with some embodiments of the invention.

Turning now to the drawings, wherein like numbers denote like parts throughout the several views, FIG. 1 illustrates an example cooking appliance 10 in which the various technologies and techniques described herein may be implemented. Cooking appliance 10 is a residential-type range, and as such includes a housing 12, a stovetop or cooktop 14 including a plurality of burners 16, and an oven 18 defining an oven or cooking cavity 20 accessed via an oven door 22. Cooking appliance 10 may also include a storage drawer 24 in some embodiments, or in other embodiments, may include a second oven. Various cooking elements (not shown in FIG. 1) may also be incorporated into cooking appliance 10 for cooking food in oven 18, e.g., one or more electric or gas heating elements.

Cooking appliance 10 may also include various user interface devices, including, for example, a control panel 26 incorporating a plurality of rotary burner controls 28 and a user interface or display 30 for providing visual feedback as to the activation state of the cooking appliance. In some embodiments, each rotary burner control 28 may include an associated electronic burner control user interface or display 32 that is disposed on or adjacent to a knob or rotary control actuator of the rotary burner control 28, while in other embodiments, no control-specific displays may be used. It will be appreciated that cooking appliance 10 may include various types of user controls in other embodiments, including various combinations of switches, buttons, knobs and/or sliders, typically disposed at the rear or front (or both) of the cooking appliance. Further, in some embodiments, one or more touch screens may be employed for interaction with a user. As such, in some embodiments, display 30 may be touch sensitive to receive user input in addition to displaying status information and/or otherwise interacting with a user. In still other embodiments, cooking appliance 10 may be controllable remotely, e.g., via a smartphone, tablet, personal digital assistant or other networked computing device, e.g., using a web interface or a dedicated app. In some embodiments, both the cooktop burners and the oven may be controlled by the same electronic control system, while in other embodiments, different control systems may be used for separate control of each system.

Each of user interfaces/displays 30, 32 may also vary in different embodiments, and may include individual indicators, segmented alphanumeric displays, and/or dot matrix displays, and may be based on various types of display technologies, including LEDs, vacuum fluorescent displays, incandescent lights, etc. Further, in some embodiments audio feedback may be provided to a user via one or more speakers, and in some embodiments, user input may be received via a spoken or gesture-based interface.

As noted above, cooking appliance 10 of FIG. 1 is a range, which combines both a stovetop and one or more ovens, and which in some embodiments may be a standalone or drop-in type of range. In other embodiments, however, cooking appliance 10 may be another type of cooking appliance, e.g., a cooktop, stovetop or hob lacking an integrated oven, a wall-mounted oven lacking an integrated cooktop, or an indoor or outdoor grill. In general, a cooking appliance consistent with the invention may be considered to include any residential-type appliance including a housing and one or more cooking elements disposed therein and configured to generate energy for cooking food.

In turn, a cooking element may be considered to include practically any type of energy-producing element used in residential applications in connection with cooking food, e.g., employing various cooking technologies such as electric, gas, light, microwaves, induction, convection, radiation, etc. In the case of an oven, for example, one or more cooking elements therein may be gas, electric, light, or microwave heating elements in some embodiments, while in the case of a cooktop, one or more cooking elements therein may be gas, electric, or inductive heating elements in some embodiments. Further, it will be appreciated that any number of cooking elements may be provided in a cooking appliance (including multiple cooking elements for performing different types of cooking cycles such as baking or broiling), and that multiple types of cooking elements may be combined in some embodiments, e.g., combinations of microwave and light cooking elements in some oven embodiments. In the case of the embodiments discussed hereinafter, at least one of the cooking elements for the cooktop and/or oven includes a gas burner and a mechanical or electromechanical valve unit that couples the gas burner to a gas supply.

Figure 2:
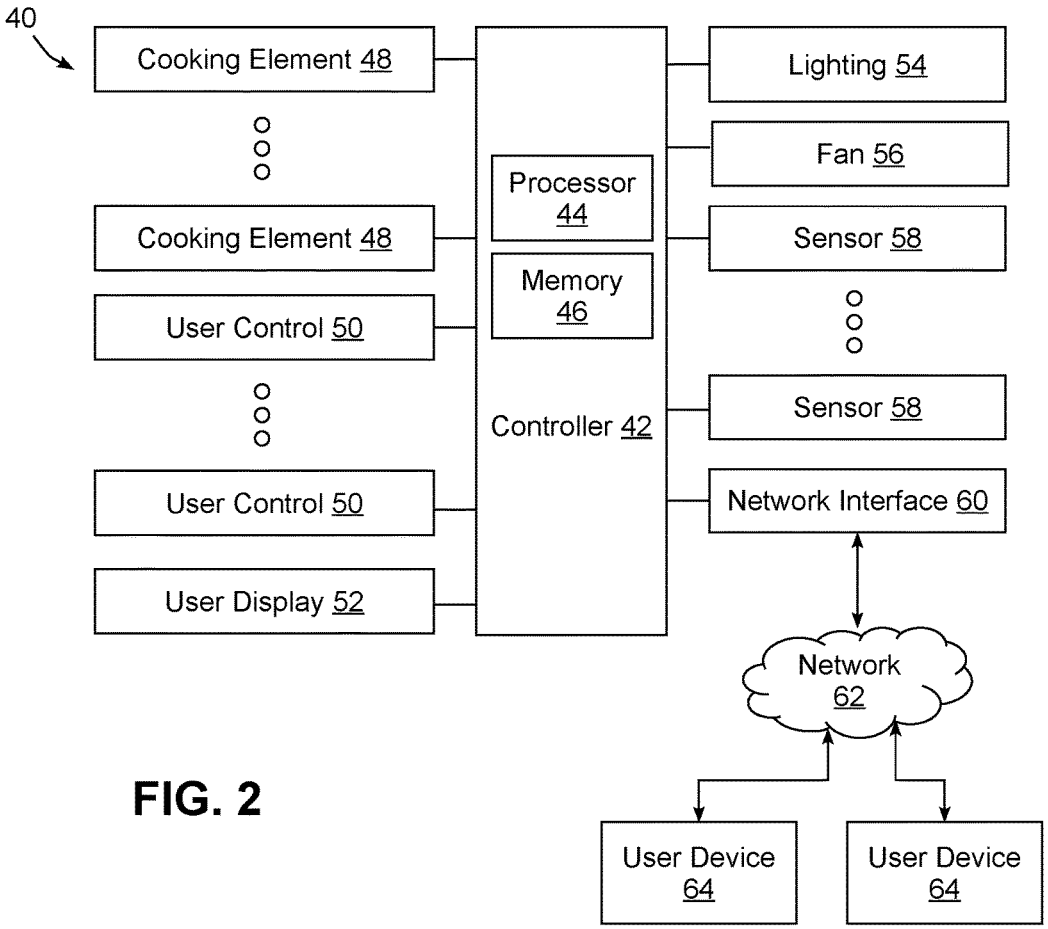
FIG. 2 is a block diagram of an example control system for a cooking appliance consistent with some embodiments of the invention.

A cooking appliance consistent with the invention also generally includes one or more controllers configured to control the cooking elements and otherwise perform cooking operations at the direction of a user. FIG. 2, for example, illustrates an example embodiment of a cooking appliance 40 including a controller 42 that receives inputs from a number of components and drives a number of components in response thereto. Controller 42 may, for example, include one or more processors 44 and a memory 46 within which may be stored program code for execution by the one or more processors. The memory may be embedded in controller 42, but may also be considered to include volatile and/or non-volatile memories, cache memories, flash memories, programmable read-only memories, read-only memories, etc., as well as memory storage physically located elsewhere from controller 42, e.g., in a mass storage device or on a remote computer interfaced with controller 42.

As shown in FIG. 2, controller 42 may be interfaced with various components, including various cooking elements 48 used for cooking food (e.g., various combinations of gas, electric, inductive, light, microwave, light cooking elements, among others), one or more user controls 50 for receiving user input (e.g., various combinations of switches, knobs, buttons, sliders, touchscreens or touch-sensitive displays, microphones or audio input devices, image capture devices, etc.), and a user display 52 (including various indicators, graphical displays, textual displays, speakers, etc.), as well as various additional components suitable for use in a cooking appliance, e.g., lighting 54 and/or one or more fans 56 (e.g., convection fans, cooling fans, etc.), among others.

Controller 42 may also be interfaced with various sensors 58 located to sense environmental conditions inside of and/or external to cooking appliance 40, e.g., one or more temperature sensors, humidity sensors, air quality sensors, smoke sensors, carbon monoxide sensors, odor sensors and/or electronic nose sensors, among others. Such sensors may be internal or external to cooking appliance 40, and may be coupled wirelessly to controller 42 in some embodiments.

In some embodiments, controller 42 may also be coupled to one or more network interfaces 60, e.g., for interfacing with external devices via wired and/or wireless networks such as Ethernet, Wi-Fi, Bluetooth, NFC, cellular and other suitable networks, collectively represented in FIG. 2 at 62. Network 62 may incorporate in some embodiments a home automation network, and various communication protocols may be supported, including various types of home automation communication protocols. In other embodiments, other wireless protocols, e.g., Wi-Fi or Bluetooth, may be used. In some embodiments, cooking appliance 40 may be interfaced with one or more user devices 64 over network 62, e.g., computers, tablets, smart phones, wearable devices, etc., and through which cooking appliance 40 may be controlled and/or cooking appliance 40 may provide user feedback.

In some embodiments, controller 42 may operate under the control of an operating system and may execute or otherwise rely upon various computer software applications, components, programs, objects, modules, data structures, etc. In addition, controller 42 may also incorporate hardware logic to implement some or all of the functionality disclosed herein. Further, in some embodiments, the sequences of operations performed by controller 42 to implement the embodiments disclosed herein may be implemented using program code including one or more instructions that are resident at various times in various memory and storage devices, and that, when read and executed by one or more hardware-based processors, perform the operations embodying desired functionality. Moreover, in some embodiments, such program code may be distributed as a program product in a variety of forms, and that the invention applies equally regardless of the particular type of computer readable media used to actually carry out the distribution, including, for example, non-transitory computer readable storage media. In addition, it will be appreciated that the various operations described herein may be combined, split, reordered, reversed, varied, omitted, parallelized and/or supplemented with other techniques known in the art, and therefore, the invention is not limited to the particular sequences of operations described herein.

Numerous variations and modifications to the cooking appliances illustrated in FIGS. 1-2 will be apparent to one of ordinary skill in the art, as will become apparent from the description below. Therefore, the invention is not limited to the specific implementations discussed herein.

As noted above, embodiments consistent with the invention may generate one or more of several different types of indications to a user associated with ignition of a gas burner on a gas cooking appliance such as a cooktop, range, grill or oven, and associated with the ignition of a gas cooktop, grill or oven burner.

Figure 3:
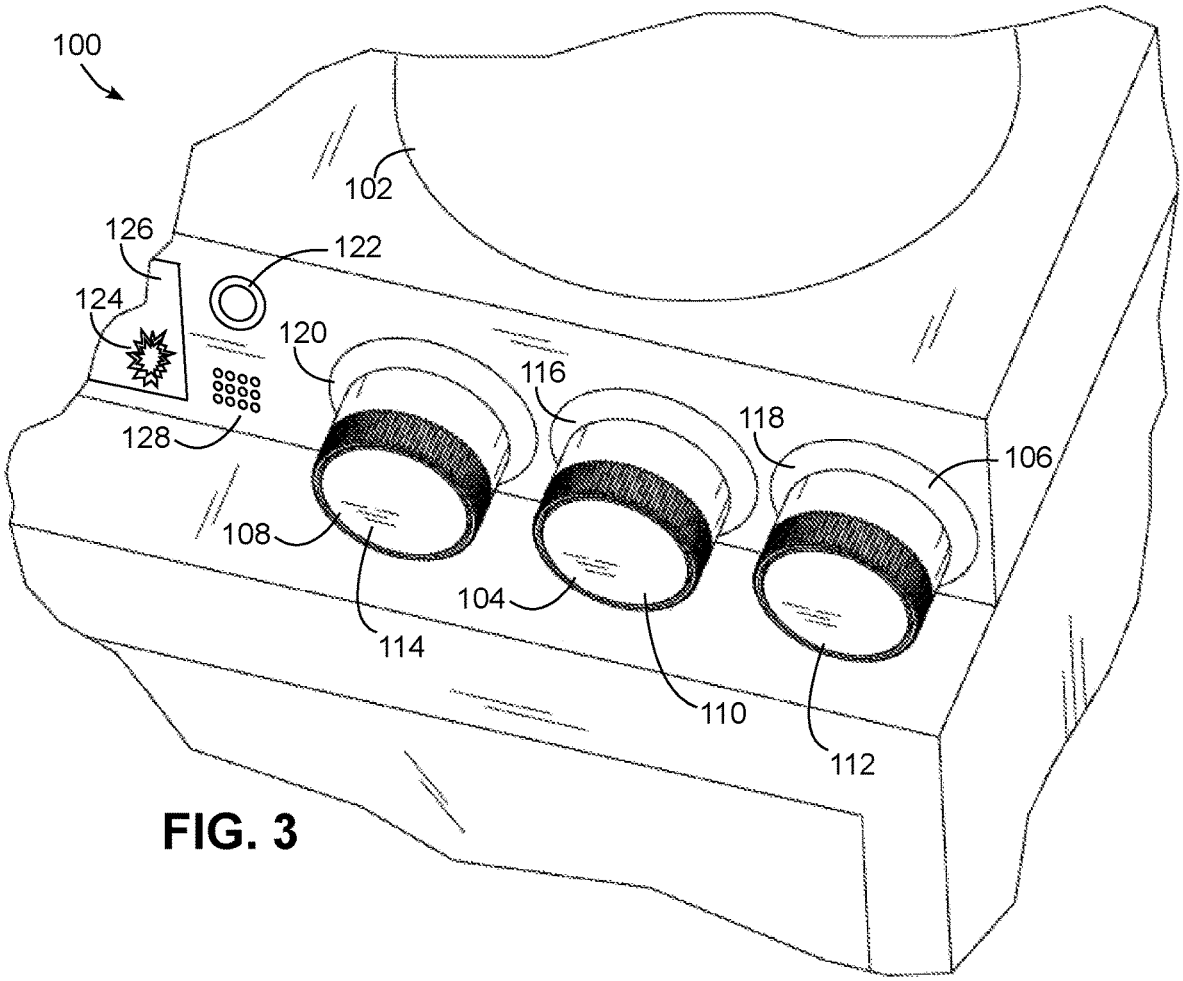
FIG. 3 is a partial perspective view of a cooking appliance implementing rotary burner control of mechanical valve units consistent with some embodiments of the invention.
Figure 4:
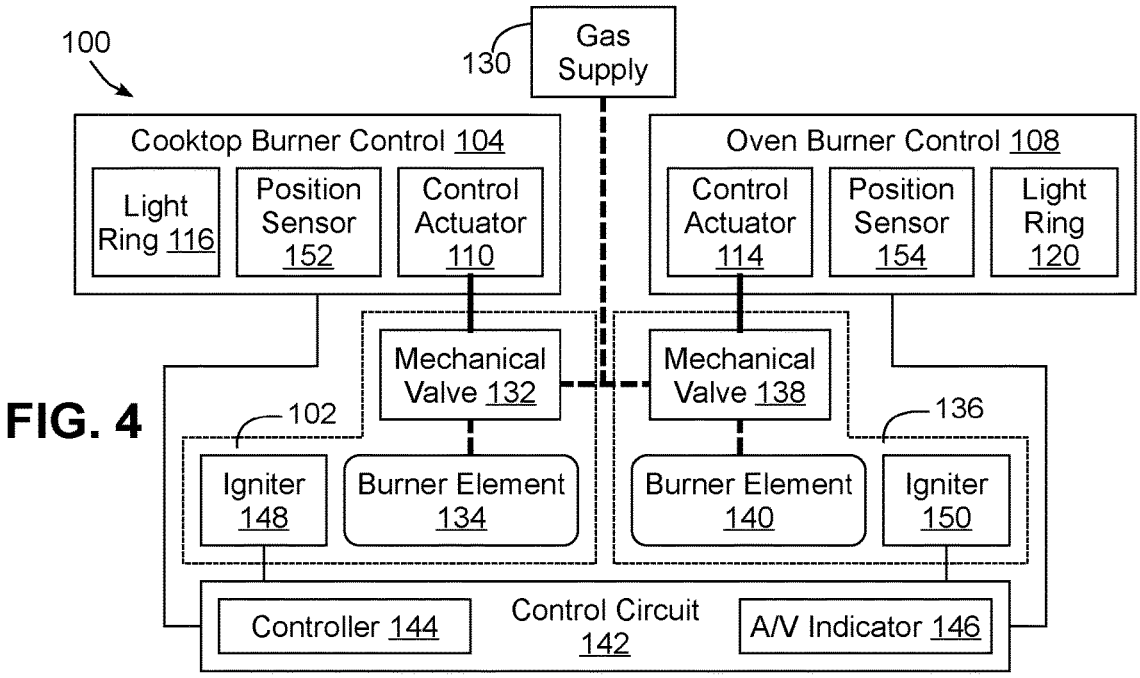
FIG. 4 is a block diagram of an example control system for the cooking appliance of FIG. 3.

In some embodiments, and as illustrated in FIGS. 3-4, a gas burner may be controlled by a mechanical valve that is mechanically coupled to a control actuator such as a knob or slider. FIG. 3, in particular, illustrates a gas range 100 including a gas cooktop burner 102 and a set of burner controls 104, 106, 108, e.g., rotary burner controls, each with a control actuator 110, 112, 114, e.g., a rotary control actuator or knob. In some embodiments, one or more of burner controls 104, 106, 108 may be used to control an oven, rather than a cooktop. In the embodiment discussed below, for example, burner control 104 is used to control gas cooktop burner 102 while burner control 108 is used to control a gas oven burner.

In order to generate indications to a user, gas range 100 may include various types of electrical indicator devices, e.g., an illuminated light or LED-backlit ring 116, 118, 120 on each burner control 104, 106, 108, a separate, dedicated visual indicator such as an LED 122 on the control panel, an illuminated icon 124 and/or text displayed on a user interface 126, or a speaker 128 for use in generating audible indications. An indication could also be generated proximate the burner itself, e.g., using a light source positioned close to the burner. An indication, in this regard, may be considered to include any type of visual and/or audible presentation to a user that may be recognized as an alert by a user, and in some instances, an indication may be generated on a device that is remove from a cooking appliance, e.g., on an interconnected smart home device, mobile device, etc. It will also be appreciated that the various indications 116, 118, 120, 122, 124 and 128 illustrated in FIG. 3 are merely shown on a single device for illustrative purposes, and that a cooking appliance consistent with the invention may utilize as few as one such indicating device, indicator, illumination source, speaker, etc. in some embodiments.

In addition, it will be appreciated that indications may be generated using devices that may also be used to indicate other status information for a cooking appliance, and that indications in some embodiments may utilize different colors, animations, patterns, text, graphical images, etc. In one example embodiment, ignition-related indications may be implemented by light rings 116, 118, 120, and that additional indications associated with the respective user controls 104, 106, 108 may also be generated using the same light rings 116, 118, 120. For example, a light ring 116, 118, 120 may be used to display a first color or pattern (e.g., a red color and/or a flashing or chasing lights pattern) to represent when the igniter of the associated burner is on or when the control actuator 110, 112, 114 is in an ignition position, and then display a second color or pattern (e.g., a blue color and/or a solid illumination pattern) to represent when the control actuator 110, 112, 114 is in an "on" position and a flame is detected. Further indications, e.g., related to flame loss or other error conditions, may also be displayed in a similar manner.

With further reference to FIG. 4, gas burner 102 may be coupled to a gas supply 130 through a mechanical valve 132 that regulates the flow of gas to a burner element 134, e.g., via a mechanical coupling to control actuator 110 of cooktop burner control 104. Similar valves and burner elements may be used for the other cooktop burners of appliance 100, but are omitted from FIG. 4 for clarity. In addition, where a gas oven is incorporated into cooking appliance 100, one or more gas oven burners 136, each including an associated mechanical valve 138 and burner element 140, may also be used. As illustrated in FIG. 4, mechanical valve 138 is mechanically coupled to control actuator 114 of oven burner control 108.

Control over cooking appliance 100 may be provided by a control circuit 142, which may include a controller 144 in some embodiments. Control circuit 142 may drive one or more audible and/or visual indicators 146 (which may correspond, for example, to any of elements 122, 124 or 128 of FIG. 3) as well as various light rings 116, 120 of burner controls 104, 108. Control circuit 142 may also drive one or more igniters 148, 150, which may be spark, hot surface or other suitable devices for igniting gas, and which, in some embodiments, may also include flame detectors or sensors and/or automatic re-ignition functionality, e.g., using a gas re-igniter module that both ignites a burner on startup and also detects and attempts to re-ignite the burner in response to a flame loss while gas is being supplied to the burner. In other embodiments, however, no automatic re-ignition functionality may be supported.

Further, in some embodiments, each burner control 104, 108 may include an associated position sensor 152, 154 that is used to detect a position of the associated control actuator 110, 114. Each position sensor 152, 154 may be implemented using practically any type of sensor capable of detecting an absolute position and/or relative movement of the rotary control actuator, e.g., an encoder, one or more microswitches, etc. While in some embodiments, a position sensor 152, 154 may have a resolution sufficient to indicate a specific position, in other embodiments a position sensor may only be sufficient to indicate when the control actuator is within a larger range of positions, e.g., in the case of a cam-driven switch that is activated throughout a relatively large range of positions of a control actuator.

Figure 5:
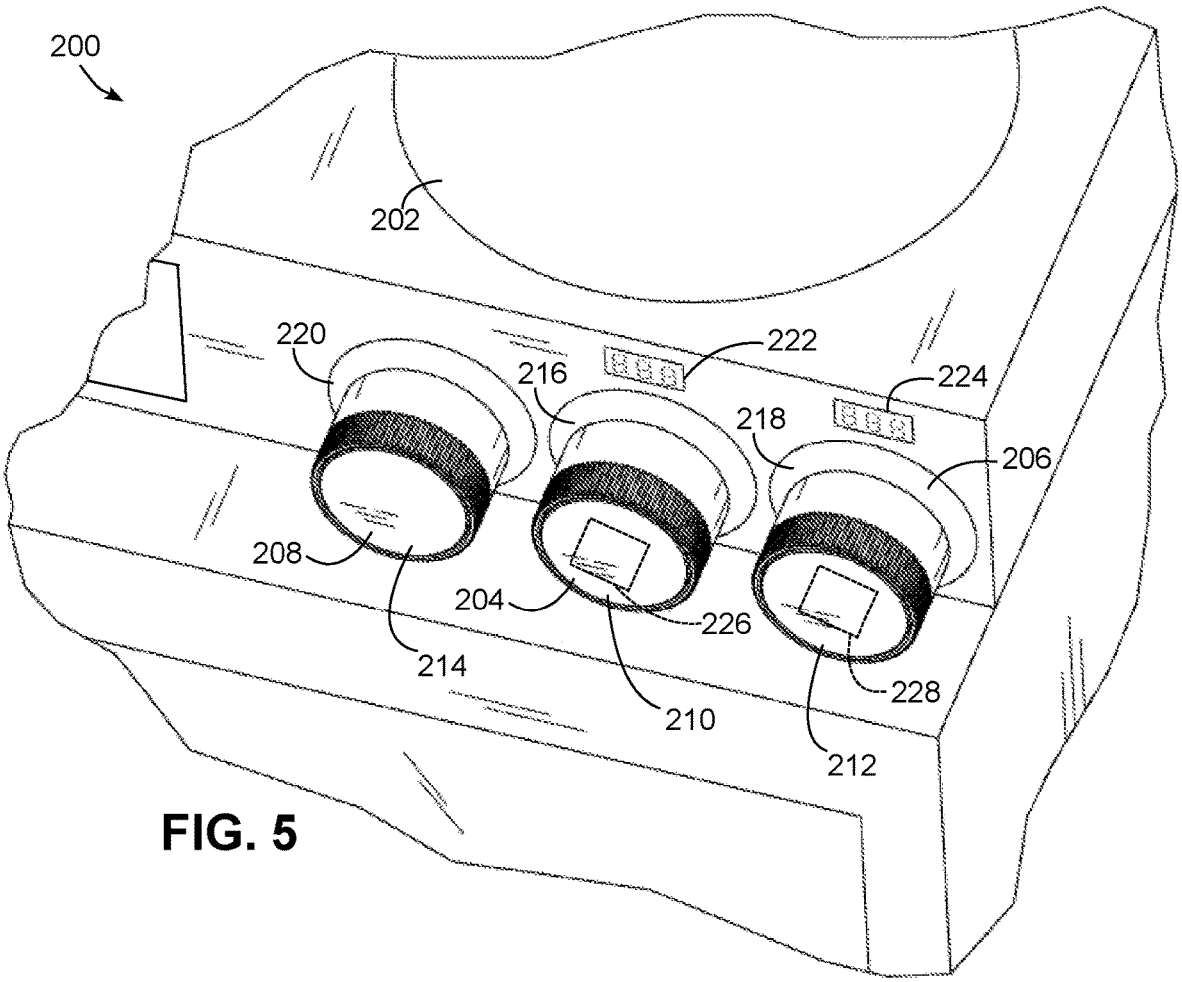
FIG. 5 is a partial perspective view of a cooking appliance implementing rotary burner control of electromechanical valve units consistent with some embodiments of the invention.

As noted above, cooking appliance 100 relies on mechanical gas valves that are mechanically coupled to burner controls. In other embodiments, however, burner controls may be coupled electronically, rather than mechanically, to electromechanical valves for the purpose of controlling a gas burner. FIG. 5, in particular, illustrates a cooking appliance 200 including a gas cooktop burner 202 and several burner controls 204, 206, 208, each with an associated control actuator 210, 212, 214 and light ring 216, 218, 220. In this embodiment, burner controls 204, 206 are used for cooktop burners and include associated user interfaces or displays 222, 224, while burner control 208 is used for an oven burner. Furthermore, at least burner controls 204, 206 include associated secondary controls 226, 228, which may be implemented as switches or touch sensors configured to detect an axial force applied to the associated control actuator 210, 212 and generate an actuation signal in response thereto, e.g., for turning a gas burner on or off or performing other user inputs, as will be discussed in greater detail below.

Figure 6:
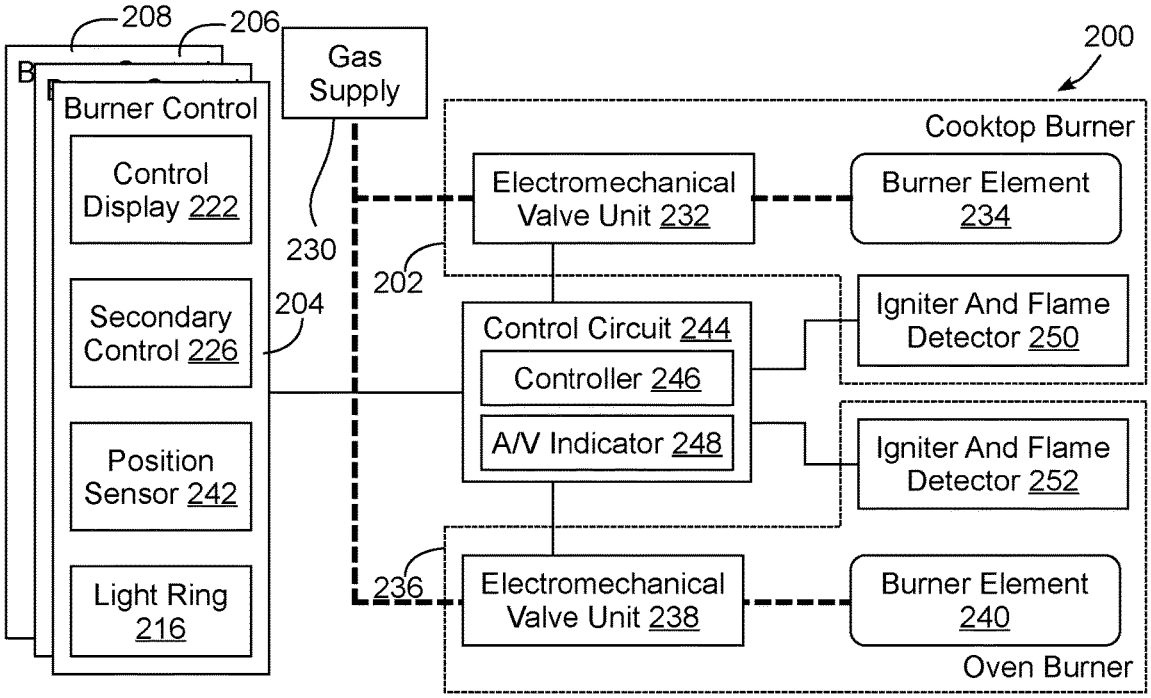
FIG. 6 is a block diagram of an example control system for the cooking appliance of FIG. 5.

With further reference to FIG. 6, gas burner 202 may be coupled to a gas supply 230 through an electromechanical valve 232 that regulates the flow of gas to a burner element 234. Similar valves and burner elements may be used for the other cooktop burners of appliance 200, but are omitted from FIG. 4 for clarity. In addition, where a gas oven is incorporated into cooking appliance 200, one or more gas oven burners 236, each including an associated electromechanical valve unit 238 and burner element 240, may also be used. An electromechanical valve unit, in this regard, may include any number of different valves and/or valve combinations that regulated the flow of gas to a gas burner in response to electronic control, e.g., an on/off or proportional valve controlled by a stepper motor, an electrically-controlled proportional valve (e.g., a normally-closed current controlled proportional valve), a parallel arrangement of discrete on/off valves having differing flow rates, or other valve designs and/or combinations of valves as will be appreciated by those of ordinary skill having the benefit of the instant disclosure.

Each burner control, e.g., burner control 110, generally includes, in addition to a control actuator, an electronic burner control user interface or display 222, light ring 216, and secondary control 226. In addition, each burner control may also include a position sensor 242, which in the illustrated embodiment is implemented as an encoder such as an A-quad-B encoder, but could also be implemented using other encoders or switches. In some embodiments, each burner control may be a rotary burner control, and may include a rotary control actuator such as a knob, ring or wheel. In the illustrated embodiment, the rotatable knob may be a continuous rotatable knob that is infinitely rotatable in both directions, while in other embodiments the knob may be rotatable only within a limited range.

An electronic burner control user interface or display may also be implemented in a number of manners in different embodiments. In the illustrated embodiment, for example, each electronic burner control user interface or display may be implemented using a multi-segment, multi-digit LED display. In other embodiments, however, such a user interface or display may be positioned in other locations adjacent the rotary control actuator, or even on the rotary control actuator itself. In some embodiments, e.g., where a rotary control actuator is a ring or wheel, such a user interface or display may be positioned on a stationary front or side surface proximate or on the rotary control actuator. In addition, the user interface or display is generally dedicated to a particular burner and rotary burner control such that the user interface or display only displays status information related to that burner and rotary burner control, e.g., a current output power level of the burner (e.g., a numerical value or label such as 0-10, a percent, a descriptor such as "low," "medium," or "high,", etc.). In other embodiments, however, other user interface technologies may be used, e.g., using dot-matrix panels, LED or LCD panels, vacuum fluorescent displays, discrete illumination sources, etc. Furthermore, user interfaces or displays may support multiple burners and rotary burner controls in some embodiments, e.g., to display status information for multiple burners having closely-positioned rotary burner controls. In still other embodiments, a single user interface or display may be used for all gas and/or cooktop burners.

Each light ring 216 may be implemented using one or more LED indicators that illuminate various portions of the burner control, and that in some embodiments may also convey additional status information, e.g., a rotary position indicator, a color or animation representing on/off status, hot burner status, and ignition-related indications as discussed herein. In other embodiments, no illumination may be supported, so backlit ring 216 may be omitted.

Each secondary control 226 may be used to provide a secondary source of user input to supplement the rotational input received via rotation of the control actuator, e.g., to activate or deactivate the gas burner, to ignite the gas burner, or provide other user input. The secondary control 226 may be implemented using a touch sensor, a mechanical or magnetic switch on rotary control actuator, a mechanical or magnetic switch capable sensing axial movement of the control actuator itself, or any other sensor capable of sensing an axial force applied generally along the axis of rotation of the rotary control actuator. In other embodiments, a secondary control may be implemented separately from a control actuator (e.g., adjacent thereto on the control panel) or may be omitted entirely.

Each position sensor 242 may be implemented using practically any type of sensor capable of detecting an absolute position and/or relative movement of the rotary control actuator, e.g., an encoder, one or more microswitches, etc. In one embodiment, an A-quad-B encoder may be used to indicate both a direction and extent of relative rotation of the rotary control actuator.

Control over appliance 200 may be provided by a control circuit 244, which in some embodiments may include a controller 246 and one or more audible and/or visual indicators 248, and which may control ignition of burners 202, 236 using igniters and flame detectors 250, 252, e.g., implementing automatic re-ignition functionality. Controller 246 in the illustrated embodiment may be used to execute instructions that implement software-based control over appliance 200; however, it will be appreciated that various aspects of the invention described herein may be implemented in control circuits lacking any controllers or other software-based functionality, so the invention is not limited to software-based controls and the like.

Active Igniter Indications

Figure 7:
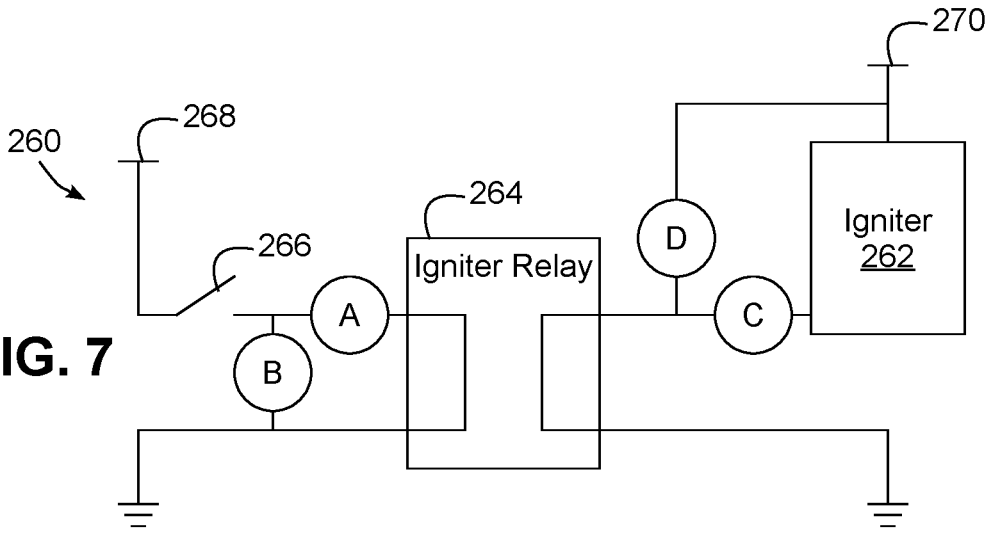
FIG. 7 is a circuit diagram of an example igniter control circuit illustrating various locations for an indicator device suitable for generating indications to a user in a manner consistent with some embodiments of the invention.

Now turning to FIG. 7, in some embodiments it may be desirable to support active igniter indications, which are used to indicate to a user when an igniter is currently active, or put another way, when an igniter is in an active state of generating a spark or heated surface suitable for igniting a gas. As noted above, sometimes due to ambient noise, the size of cookware on a cooktop burner, or the otherwise lack of visibility of an igniter to a user, it may be difficult to see or hear when an igniter is active and attempting to light a burner, even when the igniter is a spark igniter that generates sparks that have some visual and/or audible impact. Further, even in the case of a manual oven valve or a manual oven thermostat, a user often must hold the valve depressed while ignition occurs and until the flame sufficiently heats the thermocouple, yet without any indication of the active state of the igniter a user may be unable to tell whether or not the system is working.

Furthermore, where automatic re-ignition is supported, events such as spills (e.g., due to boil-over from a pan or pot on a burner), drafts (e.g., due to open doors, fans, etc.) or other related occurrences may cause flame loss, and an automatic ignition system may be capable of detecting the flame loss with a flame detector or sensor and then attempting re-ignition of the burner. Nonetheless, it may not even be apparent to a user that the flame was lost and that the appliance is attempting to re-ignite the burner if the user cannot hear the sparking or see the burner. If the user is unaware, the cooking process can be shut off without the user's knowledge.

While flame loss systems may alert a user when a flame is lost and re-ignition is unsuccessful, generally a user is not alerted when a flame loss occurs but successful re-ignition has been attained. Thus, for example, if an open door is causing a burner to periodically experience flame loss, as long as the user is unaware that the re-ignition is being performed, the user would not think to address the underlying cause of the flame out—the open door—and thereby mitigate future flame losses.

In some embodiments consistent with the invention, however, it may be desirable to utilize a control circuit in a cooking appliance to generate an indication to a user in connection with activating the igniter when gas is flowing to the gas burner and thereby notify the user that the igniter is active. In contrast with a flame loss alert, an active igniter indication may be used to indicate when ignition is being attempted, even when due to the surrounding environment a user is unable to hear or see the igniter, and thus bring to the attention of a user potential issues present within the environment that may be affecting the burner's ability to remain lit. As such, an active igniter indication may be considered to be separate from any visual and/or audible outputs of the igniter itself.

Active igniter indications may be implemented in a number of different manners in different embodiments. FIG. 7, for example, illustrates an example igniter driver circuit 260 that may implement an active igniter indication consistent with some embodiments of the invention, and particularly suitable for use in connection with mechanical gas valves and/or cooking appliances lacking software-based control over cooktop operation, e.g., in cooking appliance 100 of FIGS. 3-4. In this embodiment, an igniter 262 is driven through an igniter relay 264 by a switch 266 that closes whenever it is desirable to activate the igniter. Switch 266, for example, may be a microswitch that is closed based upon a burner control being positioned within a particular range of positions, e.g., similar to that illustrated in FIG. 12 (discussed in greater detail below). Igniter relay 264 is generally used to enable a lower voltage signal (e.g., a low DC voltage from power input 268) to be used for switch 266, while driving igniter 262 using a higher voltage signal (e.g., an AC line voltage from power input 270). In other embodiments, however, switch 266 may be software-controlled. Still further, igniter relay 264 may be omitted in some embodiments, and activation igniter 262 may simply be performed through a series connection with switch 266.

Positions A-D illustrate various representative locations in which an visual or audio device such as an LED, indicator light, light ring, speaker, etc. may be positioned in the circuit to generate an indication in connection with activation of the igniter. Positions A and B represent low voltage side positions, with position A being in series with switch 266 and position B being in parallel with switch 266, while positions C and D represent high voltage side positions, with position C being in series with igniter 262 and position D being in parallel with igniter 262. In the event that the device is coupled on the high voltage side, the device may flash with every spark. Other suitable positions and circuit will be apparent to those of ordinary skill having the benefit of the instant disclosure.

Figure 8:
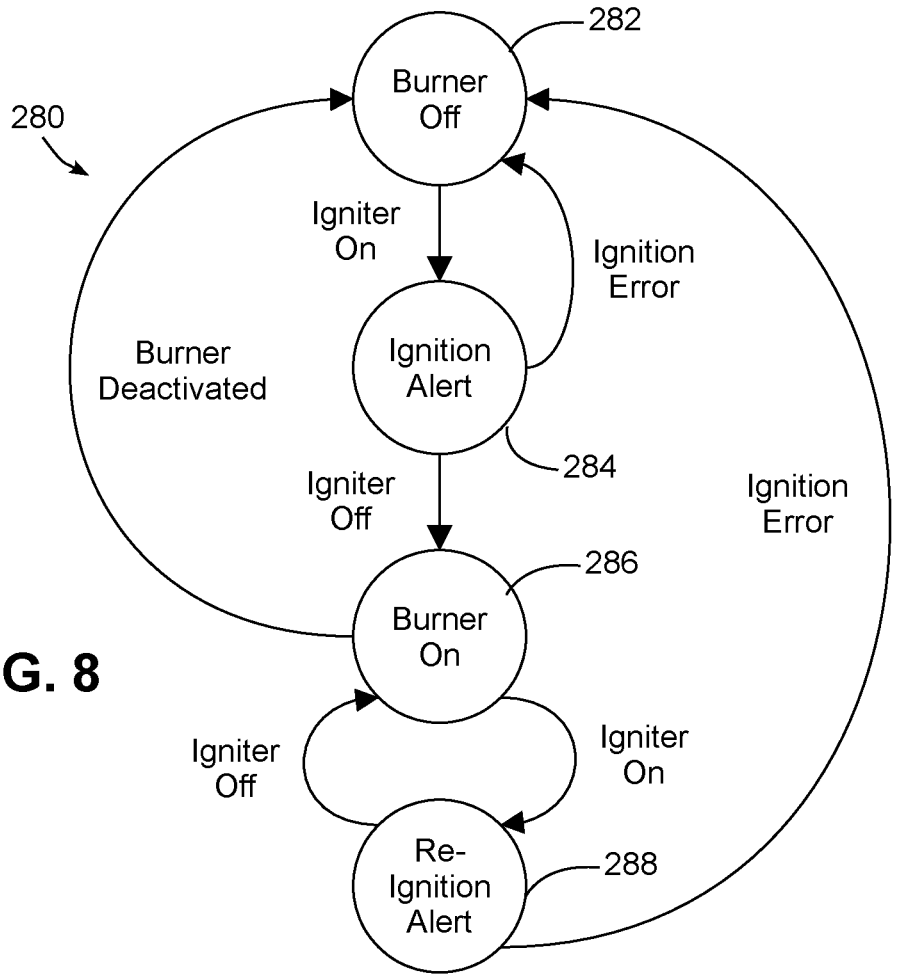
FIG. 8 is a state diagram for an example igniter control circuit consistent with some embodiments of the invention.

Even in cooking appliances that utilize software-based control and/or utilize electromechanical gas valves, active igniter indications may be of use, particularly in connection with cooking appliances incorporating automatic re-ignition functionality. FIG. 8, for example, illustrates a software state diagram 280 that may control the generation of active igniter indications in a cooking appliance that includes automatic re-ignition functionality. State 282 is a burner off state, which indicates that the burner is currently off, and when no active igniter indication is being generated. In response to the igniter being activated, e.g., due to turning a burner control to a suitable position, pressing an ignition button, or otherwise initiating an ignition sequence in a manner that is separate from the position of the burner control, a transition may occur to an ignition alert state 284, during which an active igniter indication is generated. Then, once the igniter is turned off, e.g., due to a user turning the burner control to an operative position and setting an output level for the burner, or due to a flame being detected by a flame detector, a transition may occur to a burner on state 286, during which no active igniter indication is generated.

If the burner is deactivated or shut off, control may pass back to burner off state 282. However, if a flame loss is detected, the igniter may be turned on, causing a transition to occur to a re-ignition alert state 288, during which an active igniter indication is generated, thereby indicating to a user that the appliance is attempting to re-ignite the burner. If a successful re-ignition occurs, e.g., as detected by a flame detector, a transition may occur back to state 286, turning off the indication. Further, if ignition or re-ignition is determined to be unsuccessful in either state 284 or state 288, e.g., as a result of a time-out with no flame detected, an ignition error may be signaled, and the burner turned off, with the state transitioning to burner off state 282.

In some embodiments, it may be desirable to use different indications based upon whether the burner is being ignited or re-ignited. In some embodiments, for example, it may be desirable to make the indication associated with re-ignition more pronounced than that used for the initial indication, given that the re-ignition has presumably occurred due to an unexpected flame loss and that the user may not be devoting as much attention to the cooking appliance as when he or she is first igniting the burner. It may also be desirable to enable a user to disable indications for ignitions and/or re-ignitions, e.g., through user settings.

Thus, embodiments consistent with this aspect of the invention may enable a user to be alerted whenever an igniter is active, and thereby verify correct operation of the cooking appliance. In many instances a user may also be sufficiently alerted even if the user is on the other side of a loud kitchen or otherwise attending to other activities in the kitchen and otherwise unaware that a flame loss has occurred and re-ignition is being attempted.

Ignition Position Indications

Figure 9:
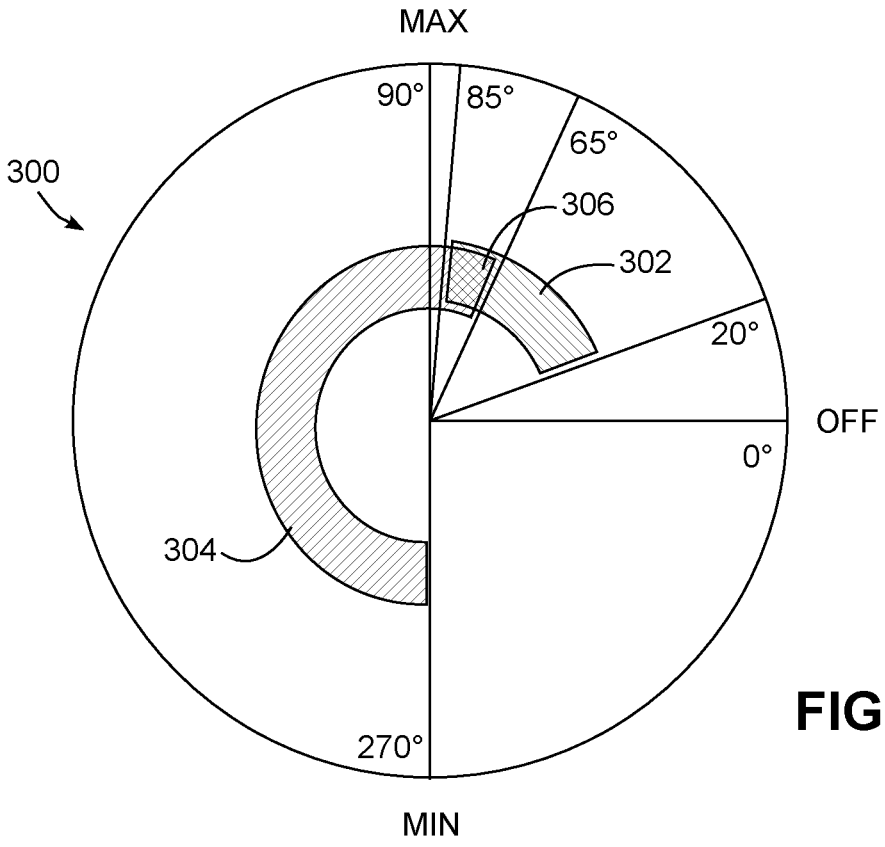
FIG. 9 is a diagram illustrating various positional ranges in the movement of a rotary burner control for a gas cooking appliance.

Now turning to FIG. 9, as noted above many gas cooking appliances utilize mechanical gas valves controlled by rotary burner controls that are mechanically coupled to the valves. In general each mechanical gas valve has an igniter switch attached to the rotary burner control that activates an igniter when a rotary control actuator such as a knob is turned beyond, and the gas valve is thus opened, over a certain range of rotation in order to ignite the burner.

In order to prevent the flow of unburned gas, the switch is generally designed to change state (and thus initiate sparking) just before the point in the gas valve's rotation when gas begins to flow. The switch is designed to remain in this state to allow sparking to continue until just before the valve reaches its maximum flow position. In many cases, e.g., for a gas valve with a 270 degree range of rotation, this state change generally occurs somewhere around 85 degrees open from the off position. The maximum flow position for the valve is generally about 90 degrees open from the off position, and this is the first position that the user is intended to use and thus sparking generally should not occur at this 90 degree position.

FIG. 9, for example, illustrates an example relationship of igniter and gas flow positions for an example mechanical gas valve 300 with 270 degrees of rotational range. In the example given, the switch for the igniter therefore allows sparking in order to ignite the burner flame over a range of rotation 302 of about 20 degrees open to about 85 degrees open.

However, it will be appreciated that ignition of the burner flame is easier to achieve near the maximum flow position of the gas valve. This means that although sparking begins before gas flow begins, ignition generally occurs best closer to the 85 degree position, when there is more flow. When the flow is smaller, the burner may not ignite at all as the flow may not be sufficient to support flames at the burner ports. So there are positions at which sparking will occur, but burner ignition cannot be achieved. FIG. 9, for example, illustrates an example range of rotation 304 from about 65 degrees open to the end of the rotation (270 degrees open), where the gas valve is considered to provide sufficient gas flow to ignite and sustain a flame on the burner. There is thus an overlap of ranges 302, 304 (labeled at 306) where both the igniter is active and there is sufficient gas flow to the gas burner to support ignition.

It has been found, however, that sometimes users are not aware of the proper position for igniting the burner. They may think that the burner should ignite in any valve position that causes the igniter to spark, and they may be forced to adjust the position of the knob back and forth until ignition occurs. Further, some users may be overly concerned with overshooting the igniter and causing gas to flow from the burner at a high rate, so such users may naturally skew towards a position near the beginning of the igniter activation, where gas flow may be insufficient.

Some appliances attempt to assist a user with positioning by printing text or icons on a knob or on a control panel to suggest a position for ignition to occur. However, it has been found that such graphics are highly vague and imprecise, and generally insufficient to properly guide a user to a position where ignition can occur.

Embodiments consistent with the invention, on the other hand, seek to generate an indication to a user whenever a burner control for a gas burner is in a suitable position for igniting the burner.

In some embodiments, for example, a burner control may be movable between first, second, third and fourth ranges of positions. In the first range of positions (generally corresponding to the 0 to 20 degree range in the example of FIG. 9), the igniter is inactive and the gas valve supplies insufficient gas flow to the gas burner to support ignition. In the second range of positions (generally corresponding to the 20 to 65 degree range in the example of FIG. 9), the igniter is active; however, the gas valve still supplies insufficient gas flow to the gas burner to support ignition. In the third range of positions (generally corresponding to the 65 to 85 degree range in the example of FIG. 9), the igniter is active and the gas valve now supplies sufficient gas flow to the gas burner to support ignition. In the fourth range of positions (generally corresponding to the 85 to 270 degree range in the example of FIG. 9), the igniter is inactive while the gas valve supplies sufficient gas flow to the gas burner to maintain a flame as well as support ignition. In the illustrated embodiments, a control circuit is configured to generate an indication to a user when the burner control is positioned within the third range of positions to assist the user in properly positioning the burner control during ignition of the burner.

Figure 10:
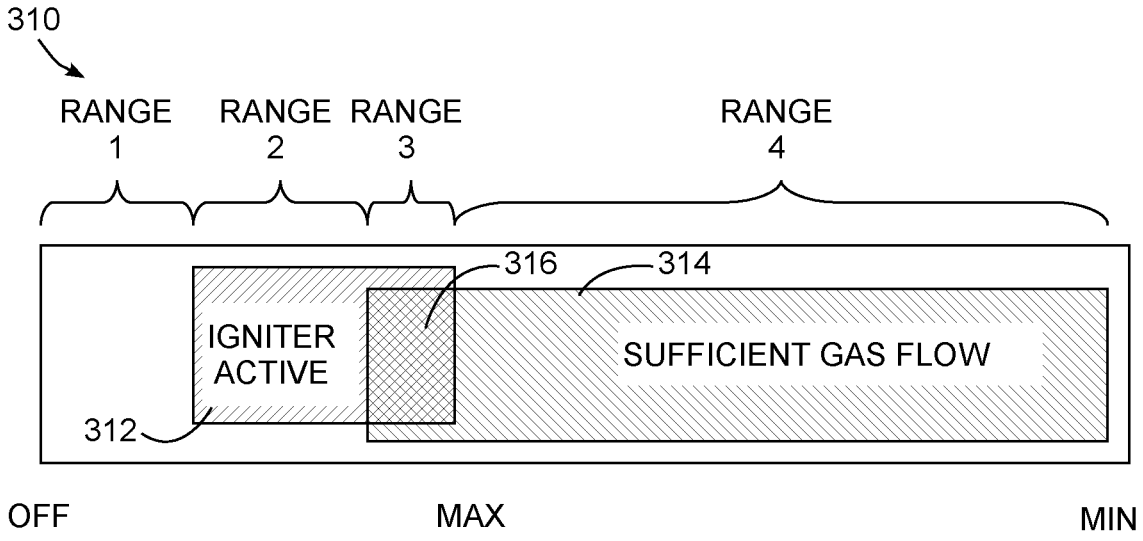
FIG. 10 is a diagram illustrating various positional ranges in the movement of a linear burner control for a gas cooking appliance.

It will be appreciated that a burner control consistent with the invention need not be a rotary control. FIG. 10, for example, illustrates a linear control 310 (e.g., a slider) that may be used in other embodiments. As with rotary burner control 300, however, linear control 310 still supports a range 312 where the igniter is active, a range 314 where sufficient gas flow is supplied by the valve to support ignition, and an overlap 316 where both conditions exist, thereby defining a similar set of four ranges (labeled ranges 1-4) as described above for rotary burner control 300.

Figure 11:
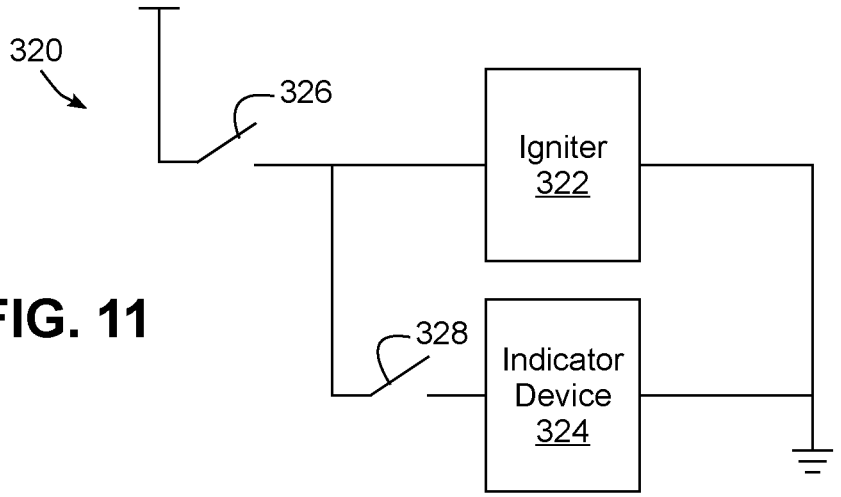
FIG. 11 is a circuit diagram of an example igniter control circuit capable of indicating an ignition position for a burner control in a manner consistent with some embodiments of the invention.

A control circuit may generate ignition position indications in various manners in various embodiments. In one example embodiment, and as illustrated in FIG. 11, a control circuit 320 may utilize an igniter 322 and an indicator device 324 (which may be any of the various types of audio and/or visual devices described above) coupled in parallel and controlled by a pair of switches 326, 328. Switch 326 alone controls activation of igniter 322, while switch 328 is coupled between switch 326 and indicator device 324 such that indicator device 324 is activated when both switches are closed. Switch 328 may be configured to be closed within the appropriate range of positions corresponding to the third range discussed above, where both the igniter is active and the valve is supplying sufficient gas flow to support ignition.

Figure 12:
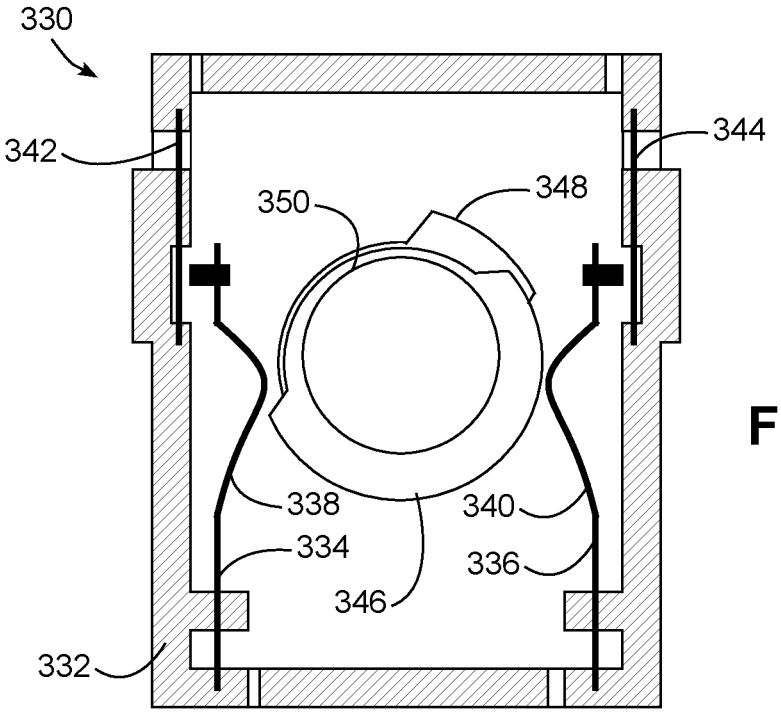
FIG. 12 is a cross-sectional diagram of an example switch configuration for a burner control for use in the igniter control circuit of FIG. 11.

One manner of configuring switches 326 and 328 to implement the herein-described functionality is illustrated by burner control 330 of FIG. 12, which includes a housing 332 and a pair of cam-lobe actuated switches 334, 336. Each switch 334, 336 includes a cantilevered leaf 338, 340 biased to a position that is separated from an associated contact 342, 344. A valve stem sleeve 346 may include a pair of cam lobes 348, 350 that are respectively configured to engage leaves 338, 340 to close the switches 334, 336 in the appropriate ranges. Switch 334 may be used, for example, to control the igniter, while switch 336 may be configured to change state at the beginning of the optimum ignition range of rotation, and thereby activate the ignition position indication. Table I, for example, illustrates one suitable switch configuration:

TABLE I

| Range | Range in Degrees | Switch 334 | Switch 336 | Igniter | Gas Flow | Position Indication |
|---|---|---|---|---|---|---|
| 1 | 0 to 20 | OFF | OFF | NO | NO | NO |
| 2 | 20 to 65 | ON | OFF | YES | From Zero to small flow | NO |
| 3 | 65 to 85 | ON | ON | YES | High Flow | YES |
| 4 | 85 to 270 (End of Rotation) | OFF | ON | NO | Operational Flow | NO |

Figure 13:
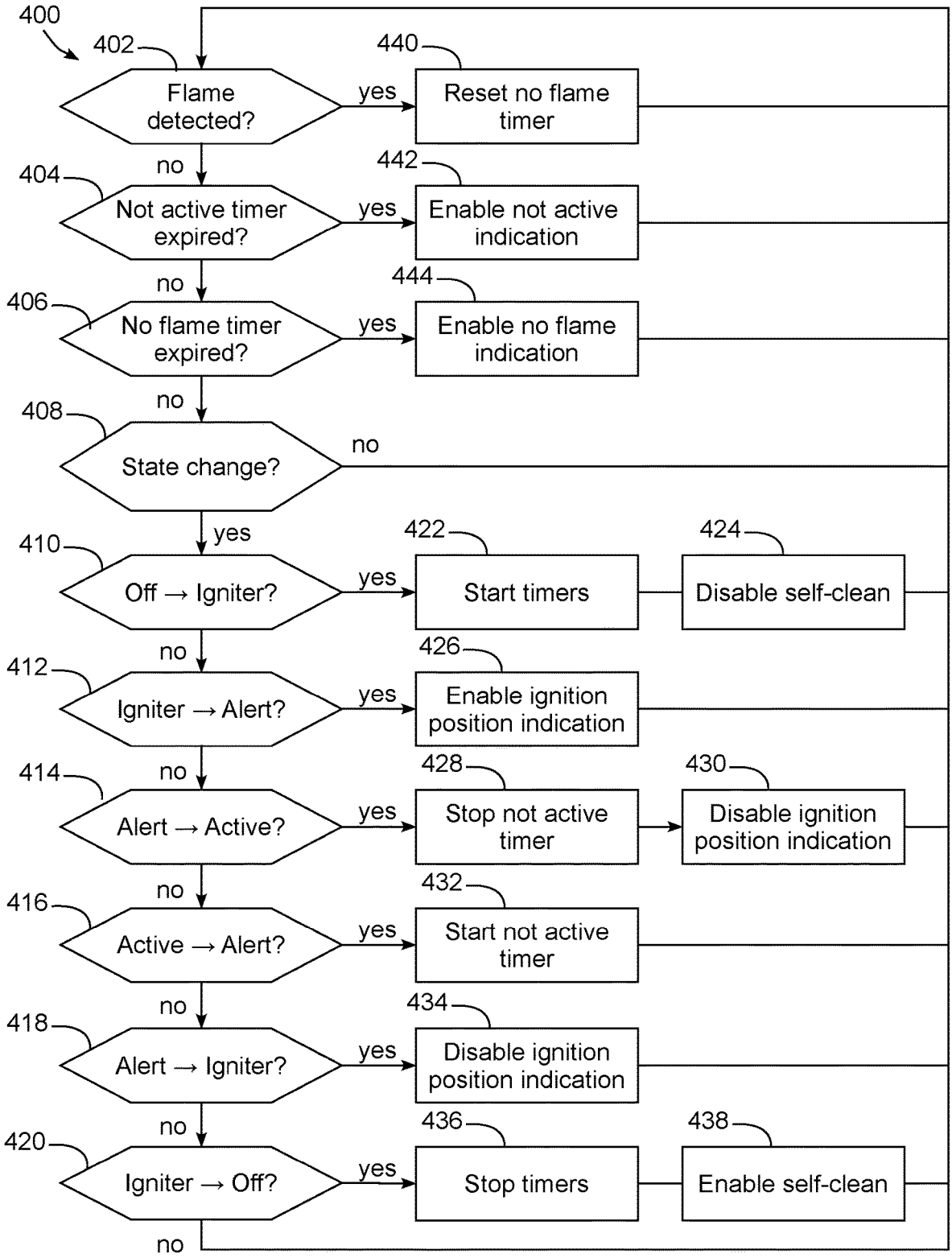
FIG. 13 is a flowchart illustrating an example sequence of operations for indicating ignition position and other operational states consistent with some embodiments of the invention.

An ignition position indication may also be used in other cooking appliance designs, including those implementing software-based control and/or using electromechanical gas valves. FIG. 13, for example, illustrates an example sequence of operations 400 that may be implemented by a controller to generate ignition position indications, whether based upon the switch design discussed above, or based on other forms of position detection, e.g., through the use of an encoder or another type of position sensor. Sequence 400 also provides, in addition to ignition position indications, sensing of one or more of the following three conditions:

Self-Clean Disable: it may be desirable in some embodiments to detect when any valve is open and flowing gas (i.e., not in the first range), and use this detection to enable or disable a self-clean function of the range. It may be desirable or necessary in some designs, for example, to disallow the use of a cooktop when an oven is in self-clean mode.

Ignition Alert: it may be desirable in some embodiments to detect if a valve is left in the second or third range for an extended period of time and signal an alert to signal cases in which a knob or other burner control may have been unintentionally rotated out of the first or fourth ranges.

Flame Loss Alert: it may be desirable in some embodiments to detect if a valve is in any of the second, third or fourth ranges for an extended period of time and no flame is detected.

It will be appreciated that any of these additional conditions may be implemented separately in different embodiments.

Sequence 400 utilizes four states, an "off" state where the burner is off (the first range discussed above), an "igniter" state where the igniter is on but insufficient gas flow is present to support ignition (the second range discussed above), an "alert" state where the igniter is on and sufficient gas flow is present to support ignition (the third range discussed above), and an "active" state where the igniter is off and sufficient gas flow is present to support ignition (the fourth range discussed above). Sequence 400 also utilizes a flame detector and a pair of timers, a not active timer that determines how long the valve is in the second or third range and a no flame timer that determines how long the valve is in any of the second, third or fourth ranges with no flame detected.

Sequence 400 loops through a series of determinations illustrated in blocks 402-420. Block 402 determines whether a flame is detected, and blocks 406 and 408 determine whether either of the not active or no flame timers have expired. Block 408 determines whether a state has changed (e.g., based on burner control position or switch activation), and blocks 410-420 handle each of the state transitions.

Block 410, for example, detects a state change from off to igniter, and calls block 422 to start the not active and no flame timers and calls block 424 to disable self-clean. Block 412 detects a state change from igniter to alert, and calls block 426 to enable the ignition position indication. Block 414 detects a state change from alert to active, and calls block 428 to stop the not active time and block 430 to disable the ignition position indication. Block 416 detects a state change from active to alert, and calls block 432 to start the not active timer. Block 418 detects a state change from alert to igniter, and calls block 434 to disable the ignition position indication. Block 420 detects a state change from igniter to off, and calls block 436 to stop the timers and calls block 438 to enable self-clean.

Block 402, as noted above, determines whether a flame is detected, and so long as a flame is detected, block 440 is called to reset the no flame timer, while blocks 404 and 406 detect whether the not active or no flame timers are expired, and responsive thereto enable the appropriate indications in blocks 442, 444.

It will be appreciated that various modifications may be made to the embodiments discussed herein, and that a number of the concepts disclosed herein may be used in combination with one another or may be used separately. Therefore, the invention lies in the claims hereinafter appended.

What is claimed is:

1. A cooking appliance, comprising:

a gas burner;

an igniter disposed adjacent to the gas burner to ignite the gas burner;

a gas valve configured to regulate gas flow to the gas burner;

a burner control coupled to the gas valve to vary the gas flow to the gas burner in response to movement of a control actuator of the burner control within a range of positions; and a control circuit coupled to the igniter and configured to activate the igniter when gas is flowing to the gas burner, and the control circuit further configured to generate an indication to a user while the igniter is activated to notify the user that the igniter is active, wherein the control circuit is configured to activate the igniter in response to a position of the burner control among the range of positions, wherein the control circuit is configured to generate the indication by generating an audible indication.

2. The cooking appliance of claim 1, wherein the control circuit includes a speaker, wherein the audible indication is generated by the speaker.

3. The cooking appliance of claim 1, further comprising a flame detector positioned to sense a flame emitted by the gas burner, wherein the control circuit is further configured to activate the igniter to re-ignite the burner in response to detecting a flame loss for the burner, and to generate a second indication to the user while the igniter is activated to notify the user that the igniter is active during re-ignition of the burner.

4. The cooking appliance of claim 1, wherein the gas valve comprises a mechanical gas valve, and wherein the burner control is mechanically coupled to the mechanical gas valve to vary the gas flow to the gas burner.

5. A cooking appliance, comprising:

a gas burner;

an igniter disposed adjacent to the gas burner to ignite the gas burner;

a flame detector positioned to sense a flame emitted by the gas burner;

a gas valve configured to regulate gas flow to the gas burner;

a burner control coupled to the gas valve to vary the gas flow to the gas burner; and a control circuit coupled to the igniter and configured to activate the igniter when gas is flowing to the gas burner, the control circuit further configured to generate a first indication to a user while the igniter is activated to notify the user that the igniter is active, and the control circuit further configured to activate the igniter to re-ignite the burner in response to detecting a flame loss for the burner with the flame detector, and to generate a second indication to the user while the igniter is activated to re-ignite the burner to notify the user that the igniter is active during re-ignition of the burner, wherein the second indication is more pronounced than the first indication.

6. The cooking appliance of claim 5, wherein the control circuit is configured to generate the first indication by generating a visual indication.

7. The cooking appliance of claim 6, wherein the burner control further comprises an illumination source, and wherein the control circuit is configured to generate the first indication using the illumination source.

8. The cooking appliance of claim 7, wherein the illumination source is a light ring that circumscribes the rotary control actuator.

9. The cooking appliance of claim 8, wherein the control circuit is configured to generate the first indication by illuminating the illumination source in a first color, and to illuminate the illumination source in a second color when the burner control is in an operational position and the igniter is not activated.

10. The cooking appliance of claim 8, wherein the control circuit is configured to generate the first indication by illuminating the illumination source using a first illumination pattern, and to illuminate the illumination source with a second illumination pattern when the burner control is in an operational position and the igniter is not activated.

11. The cooking appliance of claim 5, wherein the gas valve comprises an electromechanical gas valve, and wherein the burner control is electronically coupled to the electromechanical gas valve through the control circuit to electronically vary a rate of gas flow to the gas burner.

12. The cooking appliance of claim 11, wherein the control circuit is configured to activate the igniter in response to user input separate from a position of the burner control.

13. The cooking appliance of claim 5, wherein the gas burner is a cooktop burner.

14. The cooking appliance of claim 5, wherein the gas burner is an oven burner.

15. The cooking appliance of claim 5, wherein the control circuit includes a visual or audio device that is activated whenever the igniter is activated.

16. The cooking appliance of claim 15, wherein the visual or audio device is coupled in parallel with or in series with the igniter in an igniter driver circuit of the control circuit.

17. The cooking appliance of claim 5, wherein the igniter is a spark igniter.

18. The cooking appliance of claim 5, wherein the igniter is a hot surface igniter.

* * * * *